United States Patent [19]

Lin

[11] Patent Number: 4,742,274

[45] Date of Patent: May 3, 1988

[54] ADJUSTABLE FLASHER PLUG FOR MULTIPLE PURPOSES

[76] Inventor: Mei-mei Lin, P.O. Box 10160, Taipei, Taiwan

[21] Appl. No.: 86,796

[22] Filed: Aug. 18, 1987

[51] Int. Cl.[4] ..... H01J 7/44

[52] U.S. Cl. ..... 315/72; 315/88; 315/309

[58] Field of Search ..... 315/72, 73, 88, 309

[56] References Cited

U.S. PATENT DOCUMENTS

Re. 26,835 3/1970 Almassy ..... 315/72

2,880,370 3/1959 Arrasmith et al. ..... 315/72

3,972,531 8/1976 Knapp ..... 273/376

*Primary Examiner*—Harold Dixon

[57] ABSTRACT

An adjustable flasher plug includes two load circuits such as light indicative circuits or decorative bulbs connected in series operatively contacting a left conducting pin of two pins connecting a power source, and a bimetallic strip jacketed in a heating coil operatively connecting two conducting pins of the power source, whereby upon the heating of the coil, the bimetallic strip will be bent to alternatively shift its contact from a load circuit to the other load circuit to form a simple, compact flasher device with adjustable alternative shift (flashing) frequency of the two load circuits.

6 Claims, 2 Drawing Sheets

ADJUSTABLE FLASHER PLUG FOR MULTIPLE PURPOSES

BACKGROUND OF THE INVENTION

A conventional electronic flasher contains a simple transistor circuit known as a multivibrator which produces a series of electric pulses at a precise rate, adapted for switching a miniature relay on and off. If an indicator light circuit or a strand of decorative bulbs is controlled by the relay contacts, and so the lamps or bulbs are switched on and off by the pulses from the multivibrator.

However, one multivibrator is provided to switch a single relay with respect to a single light circuit. Multiple light circuits require plural multivibrators and relays to thereby increase their installation cost.

The present inventor has found the defect of a conventional flasher and therefore invented an adjustable flasher plug.

SUMMARY OF THE INVENTION

The object of the present invention is to provide an adjustable flasher plug including: a plug casing, a pair of conducting pins for connecting a pair of terminals of a power source, a heating coil operatively connected across the two terminals, and a bimetallic strip jacketed within the heating coil having its upper strip end normally contacting a right load circuit and operatively contacting a left load circuit as heated by the coil so as to alternatively drive two load circuits, and having its lower strip end normally biasing a coil end to electrically contact a power source for heating coil and operatively bending outwardly to disconnect the power source for switching off the load circuit and the coil as heated by the coil, thereby resulting in a on-off control for the heating coil and having an alternative flasher effect either on the left or the right load circuit.

DETAILED DESCRIPTION

Figure 1:
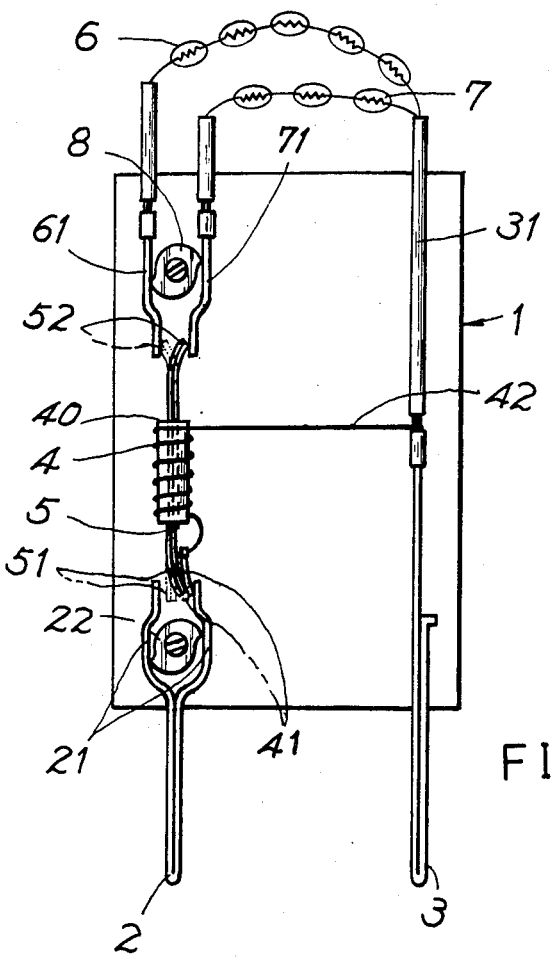
FIG. 1 is an illustration showing all elements constructing the present invention as loaded.
Figure 2:
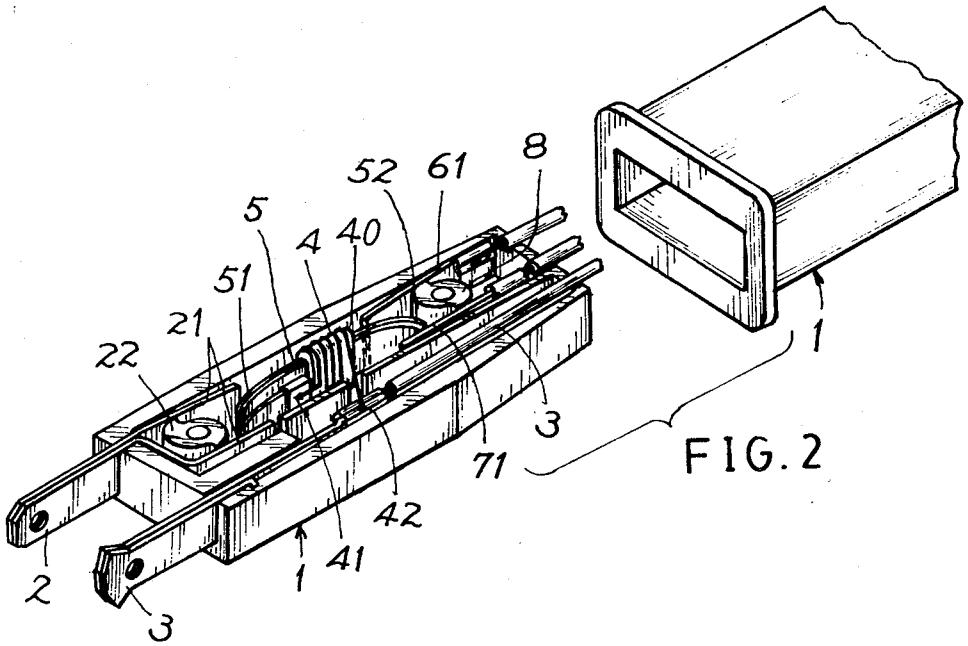
FIG. 2 is a perspective view of the present invention.

As shown in the figures, the present invention comprises: a plug casing 1, a pair of conducting pins 2, 3 for connecting pair of terminals of power source, a heating coil 4, a bimetallic strip 5, a left load circuit 6 and a right load circuit 7.

A left conducting pin 2 is formed with a fork portion 21 on its inner end, in which a lower cam 22 is rotatably provided therein to adjust a distance between the two extensions of the fork portion 21. The right conducting pin 3 is connected with a wire 31 for electrically connecting the right ends of the two load circuits 6, 7.

The heating coil 4 is wound around a mica heating medium 40 jacketed on the bimetallic strip 5 and has its one coil end 41 formed as a contact plate made of phorsphor bronze and resiliently contacting the fork portion 21 of the left pin 2 as rightwardly biased by a lower strip end 51 of the bimetallic strip 5 and normally deviating from the pin 2 when not biased by strip 51, and has its other coil end 42 connected to right pin 3. The mica heating medium 40 can transfer heat of the coil 4 to the bimetallic strip 5, but can not conduct electricity due to its electric insulation property to thereby prevent from short-circuit between the coil 4 and the bimetallic strip 5.

The bimetallic strip 5 is formed by laminating two flat metal strips with the right strip having higher heat expansion coeffeciency than that of the left strip. The lower strip end 51 normally biases the contactor plate 41 of coil 4 rightwardly to contact the left pin 2, and operatively bends leftwardly without biasing the contactor plate 41 of coil 4 as heated by the coil 4, resulting in electric disconnection of coil 4 with the pin 2. The upper strip end 52 normally contacts a contact plate 71 formed on a left end of the right load circuit 7 and operatively bends leftwardly to contact a contact plate 61 formed on a left end of the left load circuit 6 as heated by the coil 4. An upper cam 8 is rotatably provided between the two plates 61, 71 of the two circuits 6, 7 to adjust the distance between the two plates 61, 71. Either load circuit 6 or 7 can be applied as an indicator light circuit or a strand of decorative bulbs connected in series, or other flasher uses.

When using the present invention, the pair of pins 2, 3 are inserted to an electric socket for leading power source therethrough. Since the contact plate 41 of the heating coil 4 is normally biased by the lower strip end 51 of bimetallic strip 5 to electrically connect with the left pin 2, the coil 4 is powered as connected across the two pins 2, 3 to heat the bimetallic strip 5 as jacketed therein.

The upper strip end 52 as being heated by the coil 4 will bend leftwardly towards the left contact plate 61 of the left load circuit 6 to change the power connection from the right circuit 7 to the left circuit 6. The lower strip end 51 will also bend leftwardly as being heated by the coil 4 at a slower rate than the bending movement of the upper strip end 52 to ensure the alternative contacting of the upper strip 52 with either left circuit 6 or right circuit 7. The lower cam 22 made of insulating plastic materials serves to adjust the distance between the fork extensions 21, in terms of the resilient contacting of the fork portion 21 with the coil plate 41 and strip end 51. For instance, if the cam 22 is rotated to have its smaller diameter disposed between the two fork extensions 21, the resilient contacting of the coil plate 41, strip end 51 with the fork 21 will be tighter to slow their deviation from the pin 2 after being heated.

After the lower strip end 51 bends leftwardly to restore the contact plate 41 of the coil 4 to disconnect the power supply, the coil 4 is no longer heated and the upper strip end 51 will be cooled down and recovered towards its original rightward direction as contacting the right circuit 7. The lower strip end 51 will also be recovered towards the rightward direction, ready for next cycle of flashing operation. By the aforementioned alternative contactings of the right and left circuits 7, 6 with the strip 5, a flasher action can be done or any other alternative shift operations of two load circuits can be accomplished. The upper cam 8 can be used to adjust the distance between the two plates 61, 71, in terms of the speed of the alternative bending movement of the upper strip end 52 or the alternative shift frequency (flashing frequency) of the two circuits 6, 7.

Accordingly, the present invention provides a simple, compact construction, but with two load circuits which can be alternatively actuated to diversify their functions which, for instance, can be utilized to drive two strands of decorative bulbs with adjustable flashing operations.

I claim:

1. An adjustable flasher plug comprising: a plug casing; a pair of conducting pins for connecting two terminals of a power source, a left conducting pin formed with a fork portion on its inner end, and a right conducting pin connected with a wire;

a heating coil wound around a mica heating medium jacketed on a bimetallic strip having its one end formed as a contact plate operatively contacting said left pin and having its other end connected with said right pin;

said bimetallic strip having a lower strip end normally biasing said contact plate of said coil rightwardly to contact said left pin and operatively bending leftwardly to release said contact plate of said coil from contacting said left pin, and having an upper strip end;

a right load circuit having its left end formed as a contact plate normally contacting said upper strip end of said bimetallic strip and having its right end connected with said wire of said right pin;

a left load circuit having its right end formed as the other contact plate operatively contacting said upper strip end of said bimetallic strip when bending leftwardly as heated by said coil; an upper cam rotatably provided between said two contact plates of said two load circuits, adapted for adjusting a distance therebetween in terms of an alternative shift frequency of the contacting between said upper strip end with either said left circuit or said right circuit to thereby adjust the flashing frequency of the two load circuits; and a lower cam rotatably formed between two fork extensions of said fork portion of said left pin, adapted for adjusting a distance between the fork portion, in terms of a resilient contacting among said contact plate of said coil and said lower strip end of said bimetallic strip with said fork portion of said left pin.

2. An adjustable plug according to claim 1, wherein said contact plate of said coil is made of phosphor bronze material.

3. An adjustable plug according to claim 1, wherein said lower and upper cams are made of electrically insulating materials.

4. An adjustable plug according to claim 1, wherein said lower strip end of said bimetallic strip is bent at a slower rate when heated by said coil than a bending rate of said upper strip end of said bimetallic strip, as heated by said coil.

5. An adjustable plug according to claim 1, wherein said bimetallic strip is formed by laminating two flat metal strips of which the right strip has a higher heat expansion coefficiency than that of the left strip.

6. An adjustable plug according to claim 1, wherein said left or right load circuit is selected from at least a light indicator circuit or a strand of decorative bulbs connected in series.

* * * * *